US009689577B2

(12) United States Patent
Yoshimura et al.

(10) Patent No.: US 9,689,577 B2
(45) Date of Patent: Jun. 27, 2017

(54) OUTDOOR UNIT FOR AIR-CONDITIONING APPARATUS

(75) Inventors: Susumu Yoshimura, Chiyoda-ku (JP); Hiroaki Nakamune, Chiyoda-ku (JP); Syoji Yamada, Chiyoda-ku (JP); Kenichi Sakoda, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 248 days.

(21) Appl. No.: 14/379,622

(22) PCT Filed: Feb. 20, 2012

(86) PCT No.: PCT/JP2012/001110

§ 371 (c)(1),
(2), (4) Date: Aug. 19, 2014

(87) PCT Pub. No.: WO2013/124877

PCT Pub. Date: Aug. 29, 2013

(65) Prior Publication Data

US 2015/0013376 A1 Jan. 15, 2015

(51) Int. Cl.

| | |
|---|---|
| ***F25B 39/04*** | (2006.01) |
| ***F24F 1/18*** | (2011.01) |
| ***F24F 1/16*** | (2011.01) |
| ***F24F 1/38*** | (2011.01) |
| ***F24F 1/56*** | (2011.01) |

(52) U.S. Cl.
CPC ..... *F24F 1/18* (2013.01); *F24F 1/16* (2013.01); *F24F 1/38* (2013.01); *F24F 1/56* (2013.01)

(58) Field of Classification Search
CPC ..... F25B 39/04; F25B 31/00
USPC ..... 62/426, 507
See application file for complete search history.

(56) References Cited

U.S. PATENT DOCUMENTS

| | | | | |
|---|---|---|---|---|
| 3,827,483 | A | 8/1974 | Hopkinson | |
| 4,470,271 | A | 9/1984 | Draper et al. | |
| 5,498,136 | A | 3/1996 | Namura et al. | |
| 2012/0031139 | A1 * | 2/2012 | Shirota | F24F 1/0029 62/426 |

FOREIGN PATENT DOCUMENTS

| | | |
|---|---|---|
| CN | 200972216 Y | 11/2007 |
| JP | 3-99135 | 4/1991 |
| JP | 7-83002 | 3/1995 |

(Continued)

OTHER PUBLICATIONS

Office Action issued Sep. 15, 2015 in Japanese Patent Application No. 2014-500547 (with English language translation).

(Continued)

*Primary Examiner* — Melvin Jones
(74) *Attorney, Agent, or Firm* — Oblon, McClelland, Maier & Neustadt, L.L.P.

(57) ABSTRACT

An outdoor unit for an air-conditioning apparatus includes a heat exchanger, at least one fan, a compressor, and a box-shaped casing that houses the foregoing elements and has an air inlet and an air outlet. The compressor is provided at a position outside an air passage in which air taken in from the air inlet flows through the heat exchanger and the fan toward the air outlet. The heat exchanger includes a plurality of heat exchanger segments. The heat exchanger segments are arranged zigzag.

16 Claims, 7 Drawing Sheets

(56) References Cited

FOREIGN PATENT DOCUMENTS

| | | | |
|---|---|---|---|
| JP | 10-213331 | | 8/1998 |
| JP | 10-259931 | | 9/1998 |
| JP | 10-300129 | | 11/1998 |
| JP | 2000-28164 | | 1/2000 |
| JP | 2002-228193 | | 8/2002 |
| JP | 2003-120588 | A | 4/2003 |
| JP | 2006-57864 | | 3/2006 |
| JP | 2008-57480 | | 3/2008 |
| JP | 2008-202869 | | 9/2008 |
| JP | 2010-121895 | | 6/2010 |
| JP | 2010-159908 | | 7/2010 |

OTHER PUBLICATIONS

Combined Office Action and Search Report issued on Apr. 22, 2016 in Chinese Patent Application No. 201280071704.7 with partial English translation and English translation of category of cited documents.

Office Action issued on Nov. 19, 2014 in the corresponding Germany Patent Application No. 11 2012 005 908.5 (with English Translation).

International Search Report issued May 15, 2012, in PCT/JP12/001110 filed Feb. 20, 2012.

Office Action issued Dec. 9, 2016 in corresponding Chinese Patent Application No. 201280071704.7 with English Translation.

* cited by examiner

A - A (a)

(b)

OUTDOOR UNIT FOR AIR-CONDITIONING APPARATUS

TECHNICAL FIELD

The present invention relates to an outdoor unit for an air-conditioning apparatus.

BACKGROUND ART

Outdoor units for air-conditioning apparatuses in known arts each include devices, such as a heat exchanger, a fan, and a compressor, and a box-shaped casing that houses the devices. The outdoor unit allows a refrigerant to circulate between an indoor unit and the outdoor unit that are connected to each other by pipes. Heat is transferred to or received from air flowing through the heat exchanger, whereby a room is cooled or heated. Proposed examples of such a known outdoor unit for an air-conditioning apparatus include an outdoor unit that is intended to improve the performance of the air-conditioning apparatus by increasing the efficiency of heat transfer or heat reception. Such an outdoor unit includes a heat exchanger that has an L shape extending along two faces of a box-shaped casing so that the two faces of the casing are utilized, or a U shape extending along three faces of the casing so that the three faces of the casing are utilized while the position of a compressor is carefully considered (see Patent Literature 1, for example).

CITATION LIST

Patent Literature

Patent Literature 1: Japanese Unexamined Patent Application Publication No. 2006-57864

SUMMARY OF INVENTION

Technical Problem

One possible method of further improving the performance of the known outdoor unit for an air-conditioning apparatus without increasing the size of the unit is to provide the heat exchanger along a top plate or a bottom plate. However, such a method imposes some limitations on the installation of the outdoor unit, such as the necessity of providing a satisfactory air taking space near the top plate or the bottom plate. In addition, other problems, such as increased complexity of the assembling process, lead to a reduction in the ease of manufacture. Furthermore, since the space for providing the heat exchanger is limited as described above, the extent to which the volume of the heat exchanger installed can be increased is limited.

Another possible method of further improving the performance of the known outdoor unit for an air-conditioning apparatus without increasing the size of the unit is to increase the thickness of the heat exchanger in the direction of airflow. In such a method, however, since the temperature difference between the air and the refrigerant decreases toward the downstream side of the airflow, the improvement of the heat exchanging performance becomes saturated with the increase in the thickness. Moreover, the draft resistance, that is, the fan input, increases substantially proportionally to the thickness of the heat exchanger. Therefore, even if the volume of the heat exchanger installed is increased by increasing the thickness of the heat exchanger, an improvement in the performance of the outdoor unit that corresponds to the increase is not expected. On the other hand, if the volume of airflow is increased, the reduction in the temperature difference between the air and the refrigerant is suppressed. Consequently, the heat exchanging performance increases substantially proportionally to the volume of airflow. However, since the draft resistance, that is, the fan input, increases with the draft speed in the heat exchanger at a higher rate than the rate of the increase in the heat exchanging performance. Therefore, the performance of the outdoor unit cannot be improved efficiently.

As described above, the known outdoor unit for an air-conditioning apparatus has a problem in that, to improve the performance of the outdoor unit by operating the heat exchanger efficiently, the size of the unit has to be increased.

The present invention is to solve the above problem and to provide an outdoor unit in which the improvement of the heat exchanging performance and the reduction of the increase in the draft resistance are achieved at the same time by increasing the volume of the heat exchanger installed but without increasing the size of the unit, whereby the performance of the outdoor unit is efficiently improved.

Solution to Problem

An outdoor unit for an air-conditioning apparatus according to the present invention includes a heat exchanger, at least one fan, a compressor, and a box-shaped casing. The casing houses the heat exchanger, the at least one fan, and the compressor and has an air inlet and an air outlet. The compressor is provided at a position outside an air passage in which air taken in from the air inlet flows through the heat exchanger and the fan toward the air outlet. The heat exchanger includes a plurality of heat exchanger segments. The heat exchanger segments are arranged zigzag.

Advantageous Effects of Invention

The outdoor unit according to the present invention includes the heat exchanger housed in the casing and including the plurality of heat exchanger segments, and the heat exchanger segments are arranged zigzag. Therefore, the volume of the heat exchanger can be increased without increasing the size of the unit. Furthermore, since the heat exchanger is installed in the casing in such a manner as to have a large air taking area, the increase in the heat exchanging performance and the reduction in the fan input caused by the reduction in the draft resistance are realized simultaneously. Furthermore, even if the volume of airflow is increased, the heat exchanging performance can be improved while the increase in the draft resistance, that is, the increase in the fan input, is suppressed.

DESCRIPTION OF EMBODIMENTS

Embodiment 1

Figure 1:
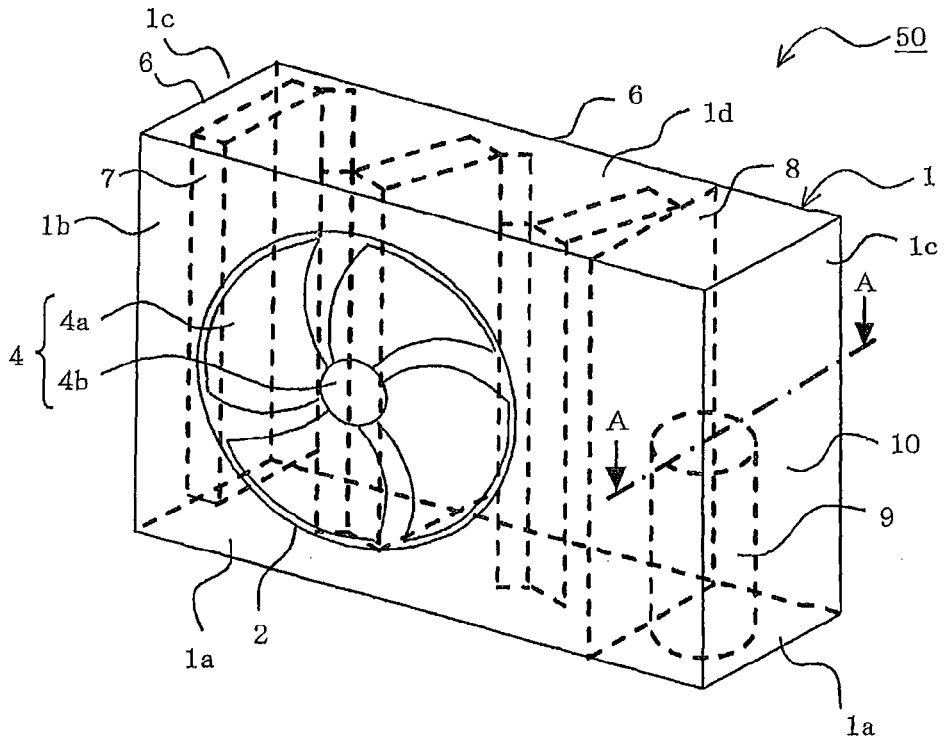
FIG. 1 is an external perspective view of an outdoor unit for an air-conditioning apparatus according to Embodiment 1 of the present invention.
Figure 2:
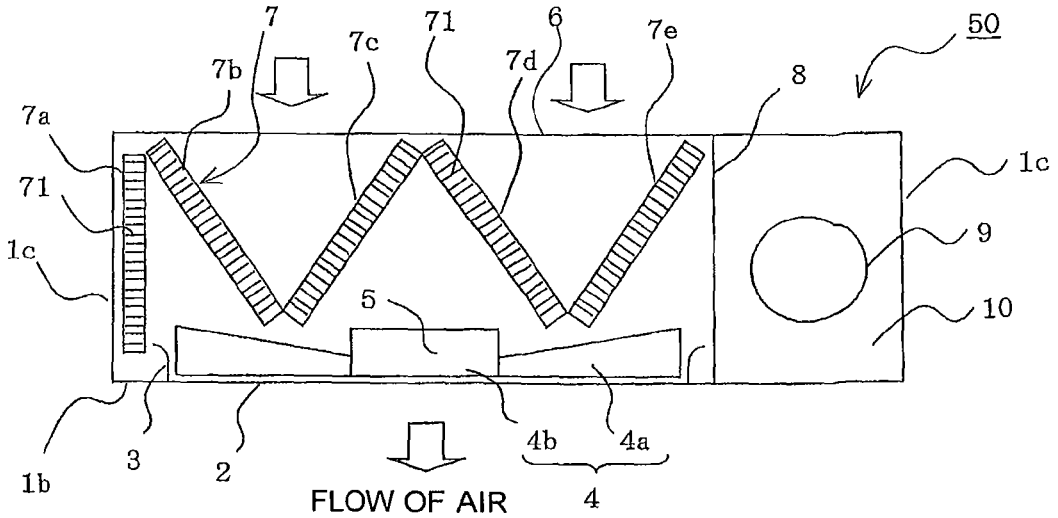
FIG. 2 is a schematic sectional view taken along line A-A illustrated in FIG. 1.

FIG. 1 is a perspective view of an outdoor unit for an air-conditioning apparatus according to Embodiment 1 of the present invention. FIG. 2 is a schematic sectional view taken along line A-A illustrated in FIG. 1. White arrows illustrated in FIG. 2 represent the flow of air passing through the outdoor unit.

Referring to FIG. 1, an outdoor unit 50 includes a box-shaped casing 1 having an air inlet 6 and an air outlet 2. The casing 1 includes, for example, a base plate 1*a* forming a bottom portion, a front panel 1*b* forming a front portion and having the air outlet 2, side panels 1*c* forming lateral side portions and a rear portion excluding an area corresponding to the air inlet 6, and a top plate 1*d* forming a top portion. In the casing 1, a heat exchanger 7 and a compressor 9 are fixed to the base plate 1*a*, and a fan 4 is attached to the base plate 1*a* with a stay interposed therebetween. The fan 4 faces the air outlet 2. A bell mouth 3 is provided on the outer periphery of the air inlet 6 in such a manner as to surround the outer periphery of the fan 4. In such a configuration, an air passage along which air taken in from the air inlet 6 by the driving of the fan 4 flows through the heat exchanger 7 and the fan 4 toward the air outlet 2 is formed in the casing 1. The compressor 9 is fixed at a position outside the air passage. In Embodiment 1, the space in the casing 1 is separated by a partition 8 into a machine chamber 10 in which the compressor 9 is housed and the air passage in which the heat exchanger 7 and the fan 4 are housed.

The fan 4 is an axial-flow fan and includes a boss 4*b*, a plurality of blades 4*a* provided around the outer periphery of the boss 4*b*, and a fan motor 5 that rotates the boss 4*b* and the blades 4*a* about the center of the boss 4*b*. In Embodiment 1, the thickness of the blades 4*a* in the axial direction is reduced by reducing the blade width while increasing the number of blades. The fan motor 5, which is hidden in the drawing, is housed in the boss 4*b*.

As illustrated in FIG. 2, the heat exchanger 7 is divided into five heat exchanger segments (heat exchanger segments 7*a*, 7*b*, 7*c*, 7*d*, and 7*e*). The heat exchanger segments 7*a* to 7*e* are provided side by side in the horizontal direction and in a zigzag arrangement. That is, the heat exchanger 7 according to Embodiment 1 has four folded portions (positions where ends of adjacent heat exchanger segments are connected). An end of each of the heat exchanger segments 7*b*, 7*c*, 7*d*, and 7*e* that faces the fan 4 is positioned closely to the fan 4, whereby the heat exchanger 7 has a satisfactorily large draft area. The heat exchanger 7, that is, the heat exchanger segments 7*a* to 7*e*, includes fins 71 and heat transfer tubes (not illustrated). The fins 71 are each a strip-like plate extending in a direction orthogonal to the surface of the drawing (in the vertical direction) and are stacked at specific intervals in the horizontal direction in such a manner as to provide gaps through which air flows.

Note that the "vertical direction" referred to in Embodiment 1 does not necessarily exactly coincide with the direction of gravitational force and may be slightly tilted with respect to the direction of gravitational force. That is, the "vertical direction" referred to in Embodiment 1 is a substantially vertical direction. Also note that the "horizontal direction" referred to in Embodiment 1 does not necessarily exactly coincide with a direction that is orthogonal to the gravitational force and may be slightly tilted with respect to the direction that is orthogonal to the gravitational force. That is, the "horizontal direction" referred to in Embodiment 1 is a substantially horizontal direction.

An operation of the outdoor unit 50 according to Embodiment 1 will now be described.

As illustrated in FIG. 2 in which the flow of air is represented by the white arrows, the flow of air produced by the fan 4 goes from the air inlet 6, advances into the air passage defined by the base plate 1*a*, the front panel 1*b*, the side panels 1*c*, and the top plate 1*d*, and is exhausted from the air outlet 2. That is, when the fan 4 is driven, air near the outdoor unit 50 is taken in from the air inlet 6, flows into the air passage, flows between the fins 71 of the heat exchanger 7 provided in the air passage, and is exhausted from the air outlet 2. While the air flows between the fins 71 of the heat exchanger 7, the air exchanges heat with the heat exchanger 7.

As described above, in Embodiment 1, since the heat exchanger segments included in the heat exchanger 7 are arranged zigzag, the heat exchanger 7 has a satisfactorily large air taking area. Hence, it is possible to reduce the draft speed in the heat exchanger 7, whereby it is possible to reduce the draft resistance, that is, the fan input, of the heat exchanger 7. Furthermore, even if the volume of airflow is increased with the increase in the volume of the heat exchanger 7, the increase in the draft speed in the heat exchanger 7 is suppressed because the draft area is also increased. Therefore, the heat exchanging performance of the heat exchanger 7 can be efficiently improved without increasing the draft resistance.

As represented by the white arrows illustrated in FIG. 2, in the outdoor unit 50 according to Embodiment 1, the air taken in from the air inlet 6 flows through the air passage substantially linearly and is exhausted from the fan 4. Therefore, the pressure loss caused by curving, widening, narrowing, or the like of the airflow, which is a so-called shape loss, is small, and most of the pressure loss in the air passage occurs when the air flows through the heat exchanger. Hence, the fan input is reduced. Furthermore, in Embodiment 1, air flows into the outdoor unit 50 in a direction substantially parallel to the rotational axis of the fan 4, which is an airflow condition that is suitable for an axial-flow fan. Hence, the efficiency of the fan is improved. Accordingly, the fan input is reduced, and air that is less disturbed flows into the fan 4. Consequently, noise is reduced.

Furthermore, since the thickness of the fan 4 in the axial direction is reduced, the ends of the heat exchanger segments 7*b*, 7*c*, 7*d*, and 7*e* of the heat exchanger 7 that face the fan 4 are positioned much closer to the air inlet 6 (i.e., to the fan 4). Hence, the volume of the heat exchanger 7 installed in the casing 1 and the draft area of the heat exchanger 7 are increased.

In Embodiment 1, one fan 4 is provided. To increase the volume of airflow in correspondence with the increase in the volume of the heat exchanger 7 installed, a plurality of fans 4 may be provided. For example, two fans 4 may be provided such that the centers thereof are positioned closely to the connection between the heat exchanger segment 7*b* and the heat exchanger segment 7*c* (the folded portion between the heat exchanger segment 7*b* and the heat exchanger segment 7*c*) and near the connection between the heat exchanger segment 7*d* and the heat exchanger segment 7*e* (the folded portion between the heat exchanger segment 7*d* and the heat exchanger segment 7*e*), respectively. However, in Embodiment 1, one fan 4 having a large blade diameter is provided for producing a predetermined volume of airflow. This is because of the following reason. Since a predetermined volume of airflow is produced with one fan 4 having a large blade diameter, the fan 4 is efficiently operable at a relatively low rotation speed while suppressing the generation of noise. By providing several heat exchanger segments in a zigzag arrangement within an area that faces one fan 4 as described above, that is, by providing several folded portions within an area that faces one fan 4, the volume of the heat exchanger per fan 4 is increased. Therefore, the heat exchanging performance is improved without increasing the draft resistance, that is, the fan input. Moreover, the efficiency of the fan 4 is improved, and the noise generation is reduced.

In Embodiment 1, the number of folds in the heat exchanger 7 (i.e., the number of connections between the heat exchanger segments included in the heat exchanger 7) is four. However, the number of folds is not limited to four. For example, the number of folds in the heat exchanger 7 may be five or more. In that case, the draft resistance also increases. Therefore, it is preferable that the specifications of the heat exchanger 7 be selected according to need. For example, the thickness of the heat exchanger 7 may be reduced.

In Embodiment 1, the five heat exchanger segments (the heat exchanger segments 7*a*, 7*b*, 7*c*, 7*d*, and 7*e*) included in the heat exchanger 7 are provided separately from one another. Alternatively, the heat exchanger segments may be manufactured as an integral body, and the integral body may be then folded at folded portions. If the heat exchanger segments are manufactured as an integral body, no fins 71 may be provided at the folded portions, originally. If no fins 71 are provided at the folded portions, the ease of folding of the heat exchanger 7 increases. Moreover, it is originally difficult at the folded portions for air to flow smoothly, and such air makes less contribution to heat exchange. Therefore, the amount of fin material to be used can be reduced without reducing the heat exchanging performance of the heat exchanger 7.

Figure 3:
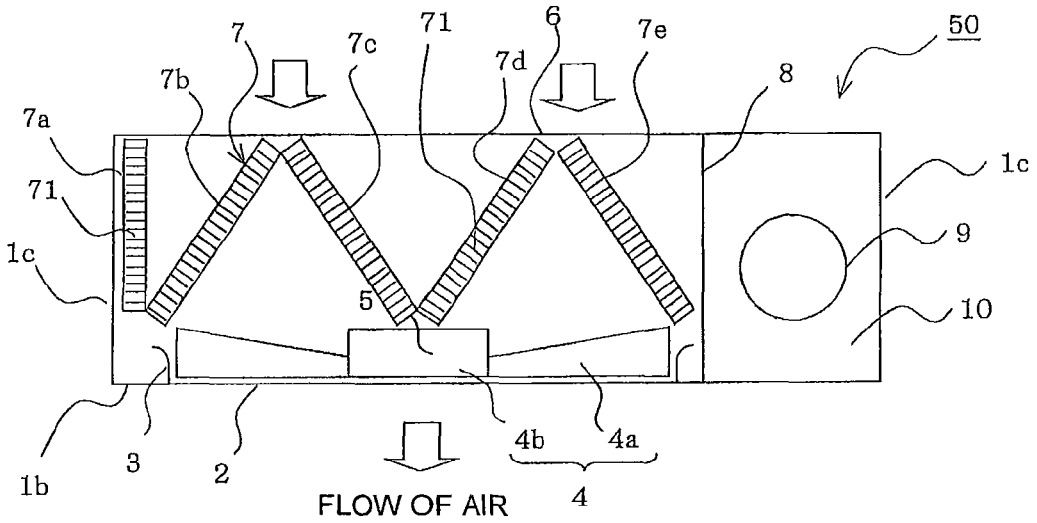
FIG. 3 is a schematic transverse sectional view of another exemplary outdoor unit for an air-conditioning apparatus according to Embodiment 1 of the present invention.

In Embodiment 1, the heat exchanger segments are arranged zigzag such that the connection (folded portion) between the heat exchanger segment 7*b* and the heat exchanger segment 7*c* and the connection (folded portion) between the heat exchanger segment 7*d* and the heat exchanger segment 7*e* are positioned closely to the fan 4 while the connection (folded portion) between the heat exchanger segment 7*c* and the heat exchanger segment 7*d* is positioned closely to the air inlet 6. However, the arrangement of the heat exchanger segments is not limited to such a pattern. For example, the heat exchanger 7 may be inverted in the direction of airflow as illustrated in FIG. 3. That is, the heat exchanger segments may be arranged zigzag such that the connection (folded portion) between the heat exchanger segment 7*b* and the heat exchanger segment 7*c* and the connection (folded portion) between the heat exchanger segment 7*d* and the heat exchanger segment 7*e* are positioned closely to the air inlet 6 while the connection (folded portion) between the heat exchanger segment 7*c* and the heat exchanger segment 7*d* is positioned closely to the boss 4*b* of the fan 4.

In Embodiment 1, the fins 71 are stacked in the horizontal direction. Alternatively, the fins 71 may be stacked in the vertical direction. In the latter case, the gaps between the fins 71 each spread in the horizontal direction. Therefore, air easily flows in the horizontal direction while passing through the heat exchanger 7, producing an effect of further reducing the draft resistance of the heat exchanger 7. Consequently, the fan input is further reduced.

In summary, the outdoor unit 50 according to Embodiment 1 includes the heat exchanger 7 housed in the casing 1 and including a plurality of heat exchanger segments, and the heat exchanger segments are arranged zigzag. Therefore, the volume of the heat exchanger 7 installed can be increased without increasing the size of the unit. Furthermore, since the heat exchanger 7 is installed in such a manner as to have a large draft area, the increase in the heat exchanging performance and the reduction in the draft resistance (i.e., the fan input) are realized simultaneously. Furthermore, even if the volume of airflow is increased, the heat exchanging performance of the heat exchanger 7 can be improved while the increase in the draft resistance of the heat exchanger 7 is suppressed.

Compared with the known outdoor unit in which the heat exchanger extends along side faces of the casing, the outdoor unit 50 according to Embodiment 1 in which the heat exchanger 7 has a zigzag shape produces the following advantageous effects. Note that, in the following description, the volume of the heat exchanger is defined as "stack length (distance between fins at two respective ends in the fin stacking direction)"×"length of each fin in the longitudinal direction"×"length of each fin in the short-side direction." In the case of the heat exchanger 7 according to Embodiment 1 that includes a plurality of heat exchanger segments, the sum total of the volumes of the respective heat exchanger segments corresponds to the volume of the heat exchanger 7.

(1) Case of Outdoor Unit According to Embodiment 1 Including Heat Exchanger 7 in which Fins 71 are Stacked in Horizontal Direction and Long-Side Direction of Each Fin 71 Corresponds to Vertical Direction (See FIG. 2)

Supposing that the known outdoor unit and the outdoor unit 50 according to Embodiment 1 are of the same size and the heat exchangers included in the respective outdoor units have the same volume, the stack length of the heat exchanger 7 included in the outdoor unit 50 according to Embodiment 1 (i.e., the sum total of the stack lengths of all heat exchangers) can be made larger than that of the known outdoor unit. Therefore, the length of each fin 71 in the short-side direction (i.e., the thickness of the heat exchanger 7) can be reduced. Moreover, the length of each fin in the short-side direction has a correlation with the number of rows of heat transfer tubes arranged in the short-side direction of the fin. Therefore, if the known outdoor unit and the outdoor unit 50 according to Embodiment 1 are of the same size and the heat exchangers included in the respective outdoor units have the same volume, the number of rows of heat transfer tubes 72 included in the outdoor unit 50 according to Embodiment 1 can also be reduced.

(2) Case of Outdoor Unit According to Embodiment 1 Including Heat Exchanger 7 in which Fins 71 are Stacked in Vertical Direction Supposing that the known outdoor unit and the outdoor unit 50 according to Embodiment 1 are of the same size and the heat exchangers included in the respective outdoor units have the same volume, the sum total of the lengths of the heat exchangers, in the long-side direction of each fin 71, included in the outdoor unit 50 according to Embodiment 1 can be made larger than that of the known outdoor unit. Therefore, the length of each fin 71 in the short-side direction (i.e., the thickness of the heat exchanger 7) can be reduced. Hence, if the known outdoor unit and the outdoor unit 50 according to Embodiment 1 are of the same size and the heat exchangers included in the respective outdoor units have the same volume as described above, the number of rows of heat transfer tubes 72 included in the outdoor unit 50 according to Embodiment 1 can also be reduced.

As is obvious from cases (1) and (2) described above, if the heat exchangers 7 have the same volume, the length in the stacking direction can be made larger and the length of each fin 71 in the short-side direction can be made smaller (the number of rows can be made smaller) in the configuration according to Embodiment 1 than in the known configuration. Thus, the improvement of the heat exchanging performance and the reduction in the draft resistance are simultaneously realized. Therefore, the heat exchanger 7 included in the outdoor unit 50 according to Embodiment 1 is operable more efficiently than that included in the known outdoor unit. Hence, the performance of the outdoor unit 50 can be improved without increasing the size of the unit. In other words, the outdoor unit 50 according to Embodiment 1 provides the same level of performance as in the known outdoor unit by employing the heat exchanger 7 having a volume that is reduced in correspondence with the level of improvement in the performance. Consequently, cost reduction is also realized.

Embodiment 2

In Embodiment 1, the heat exchanger segments are provided side by side in the horizontal direction and in a zigzag arrangement, that is, the heat exchanger 7 is folded in the horizontal direction. The present invention is not limited to such a configuration. For example, the present invention can also be embodied by providing the following heat exchanger 7 in the casing 1. Note that elements that are not specifically described in Embodiment 2 are the same as those described in Embodiment 1, and like functions and configurations are denoted by like reference numerals.

Figure 4:
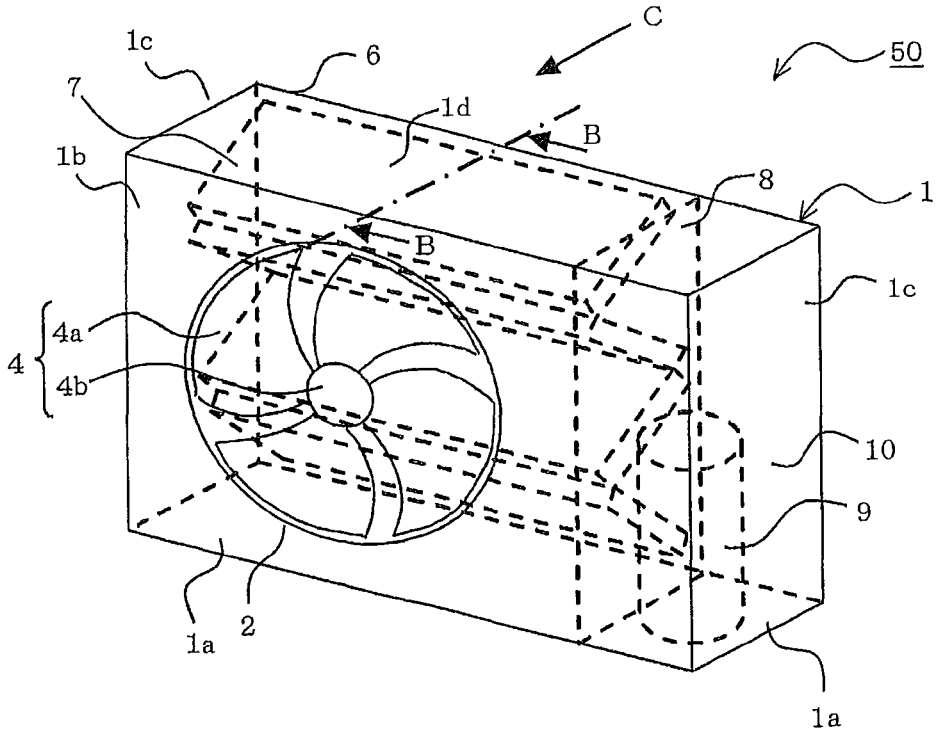
FIG. 4 is an external perspective view of an outdoor unit for an air-conditioning apparatus according to Embodiment 2 of the present invention.
Figure 5:
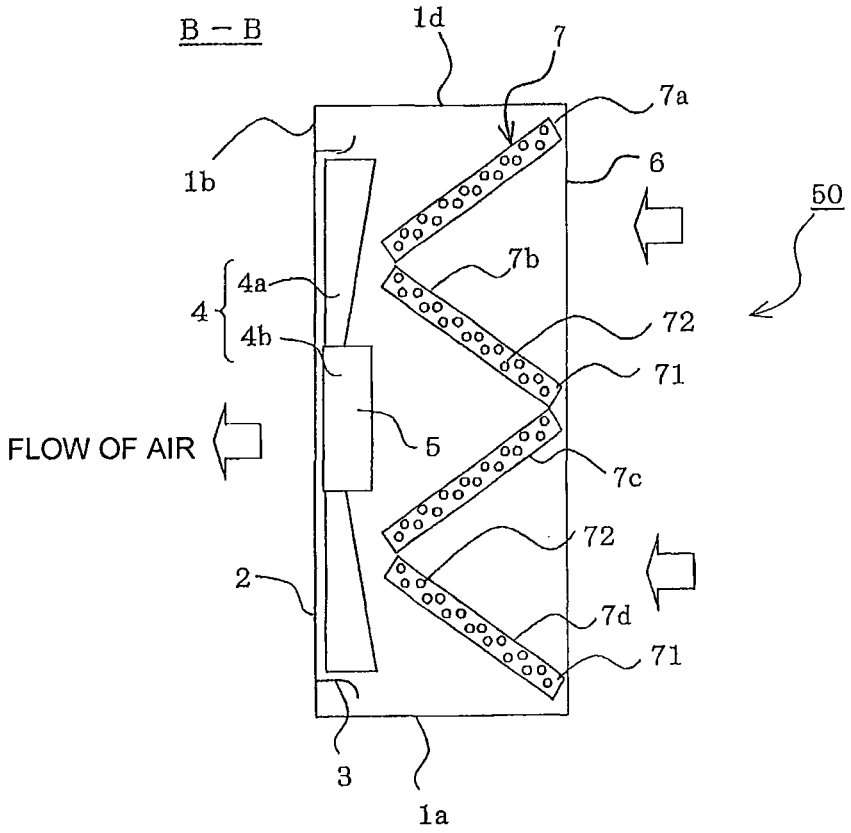
FIG. 5 is a schematic sectional view taken along line B-B illustrated in FIG. 4.

FIG. 4 is a perspective view of an outdoor unit for an air-conditioning apparatus according to Embodiment 2 of the present invention. FIG. 5 is a schematic sectional view taken along line B-B illustrated in FIG. 4. White arrows illustrated in FIG. 5 represent the flow of air passing through the outdoor unit.

As illustrated in FIG. 5, the heat exchanger 7 according to Embodiment 2 is divided into four heat exchanger segments (heat exchanger segments 7*a*, 7*b*, 7*c*, and 7*d*). The heat exchanger segments 7*a* to 7*d* are provided side by side in the vertical direction and in a zigzag arrangement. That is, the heat exchanger 7 according to Embodiment 2 has three folded portions (positions where ends of adjacent heat exchanger segments are connected). An end of each of the heat exchanger segments 7*a*, 7*b*, 7*c*, and 7*d* that faces the fan 4 is positioned closely to the fan 4, whereby the heat exchanger 7 has a satisfactorily large draft area. The heat exchanger 7, that is, the heat exchanger segments 7*a* to 7*d*, includes fins 71 and heat transfer tubes 72. The fins 71 are stacked at specific intervals in the horizontal direction in such a manner as to provide gaps through which air flows.

In addition to the advantageous effects described in Embodiment 1, the outdoor unit 50 according to Embodiment 2 has an advantageous effect of further reducing the draft resistance of the heat exchanger 7 because the gaps between the fins 71 spread in the vertical direction, allowing air to easily flow in the vertical direction when passing through the heat exchanger 7. Thus, the fan input is further reduced. Furthermore, even if the volume of airflow is increased with the increase in the volume of the heat exchanger 7 installed, the increase in the draft speed in the heat exchanger 7 is suppressed because the draft area is also increased. Therefore, the heat exchanging performance of the heat exchanger 7 can be efficiently improved without increasing the draft resistance.

In Embodiment 2, the number of folds in the heat exchanger 7 (i.e., the number of connections between the heat exchanger segments included in the heat exchanger 7) is three. However, the number of folds is not limited to three. For example, the number of folds in the heat exchanger 7 may be four or more. In that case, the draft resistance also increases. Therefore, it is preferable that the specifications of the heat exchanger 7 be selected according to need. For example, the thickness of the heat exchanger 7 may be reduced.

In Embodiment 2, the four heat exchanger segments (the heat exchanger segments 7*a*, 7*b*, 7*c*, and 7*d*) included in the heat exchanger 7 are provided separately from one another. Alternatively, the heat exchanger segments may be manufactured as an integral body while, for example, slits are made in some of the fins 71 that are provided in portions to be folded, and the integral body may be then folded at those portions. It is originally difficult at the folded portions for air to flow smoothly, and such air makes less contribution to heat exchange. Therefore, the amount of fin material to be used can be reduced without reducing the heat exchanging performance of the heat exchanger 7 even if no fins 71 are provided at the folded portions.

In Embodiment 2, the heat exchanger segments are arranged zigzag such that the connection (folded portion) between the heat exchanger segment 7*a* and the heat exchanger segment 7*b* and the connection (folded portion) between the heat exchanger segment 7*c* and the heat exchanger segment 7*d* are positioned closely to the fan 4 while the connection (folded portion) between the heat exchanger segment 7*b* and the heat exchanger segment 7*c* is positioned closely to the air inlet 6. However, the arrangement of the heat exchanger segments is not limited to such a pattern. For example, the heat exchanger 7 may be inverted in the direction of airflow. That is, the heat exchanger segments may be arranged zigzag such that the connection (folded portion) between the heat exchanger segment 7*a* and the heat exchanger segment 7*b* and the connection (folded portion) between the heat exchanger segment 7*c* and the heat exchanger segment 7*d* are positioned closely to the air inlet 6 while the connection (folded portion) between the heat exchanger segment 7*b* and the heat exchanger segment 7*c* is positioned closely to the boss 4*b* of the fan 4.

Figure 6:
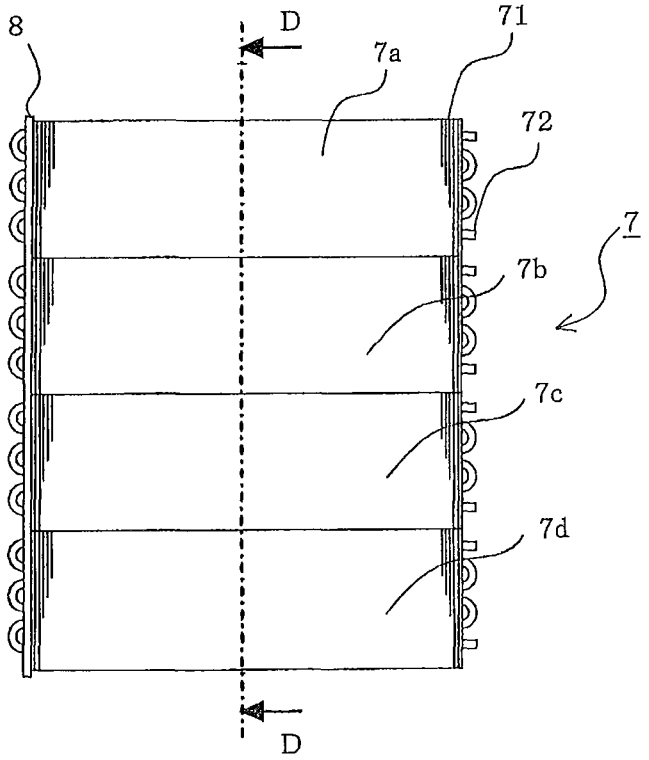
FIG. 6 includes diagrams illustrating another exemplary heat exchanger included in the outdoor unit for an air-conditioning apparatus according to Embodiment 2 of the present invention.
Figure 6:
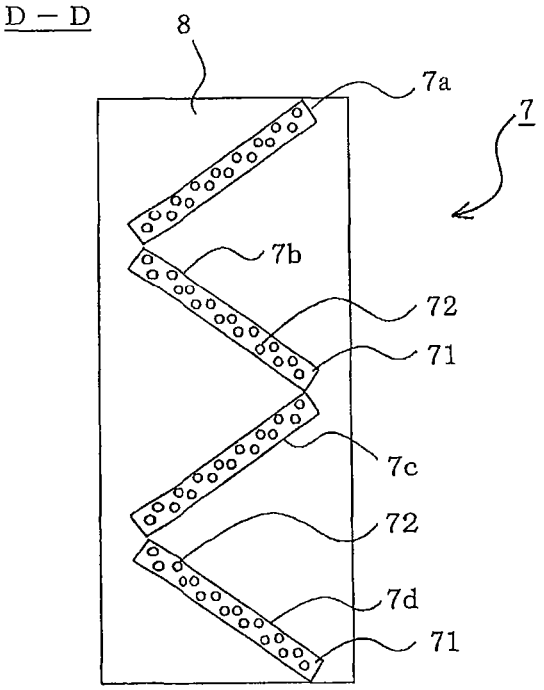

Alternatively, the heat exchanger 7 may be configured as illustrated in FIG. 6.

FIG. 6 includes diagrams illustrating another exemplary heat exchanger included in the outdoor unit for an air-conditioning apparatus according to Embodiment 2 of the present invention. FIG. 6(*a*) is a diagram (rear view) of the heat exchanger 7 seen in the direction of arrow C illustrated in FIG. 4. FIG. 6(*b*) is a schematic sectional view taken along line D-D illustrated in FIG. 6(*a*).

In the heat exchanger 7 illustrated in FIG. 6, the partition 8 and a side plate of the heat exchanger 7 are designed to be integrated with each other to serve as both. In the heat exchanger 7 having such a configuration, a cost reduction is realized by the common design of the two components, and a reduction in the number of components to be assembled is realized by the integration of the heat exchanger 7 and the partition 8. Moreover, the assembly process is simplified. Furthermore, since the heat exchanger 7, that is, the heat exchanger segments 7*a* to 7*d*, is fixed to the partition 8, the accuracy in arranging the heat exchanger segments 7*a* to 7*d* in a predetermined zigzag manner in the vertical direction increases.

Embodiment 3

The outdoor unit 50 according to Embodiment 1 or Embodiment 2 may alternatively include a fan 4 described below, for example. Note that items that are not specifically described in Embodiment 3 are the same as those described in Embodiment 1 or 2, and like functions and like elements are denoted by like reference numerals.

Figure 7:
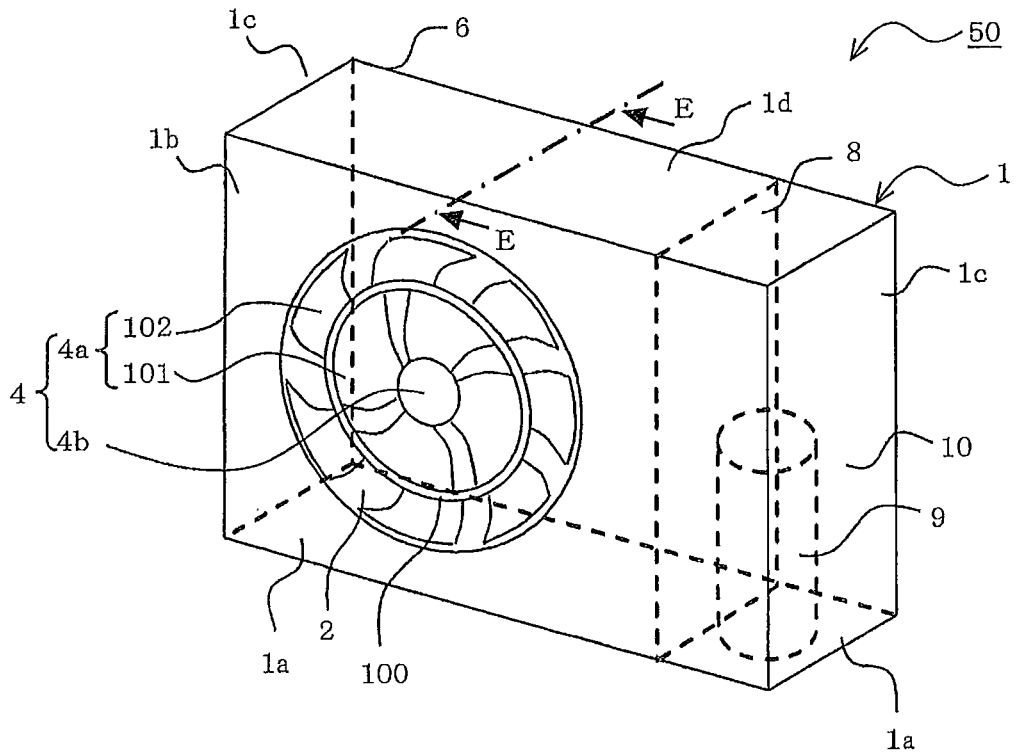
FIG. 7 is an external perspective view of an outdoor unit for an air-conditioning apparatus according to Embodiment 3 of the present invention.
Figure 8:
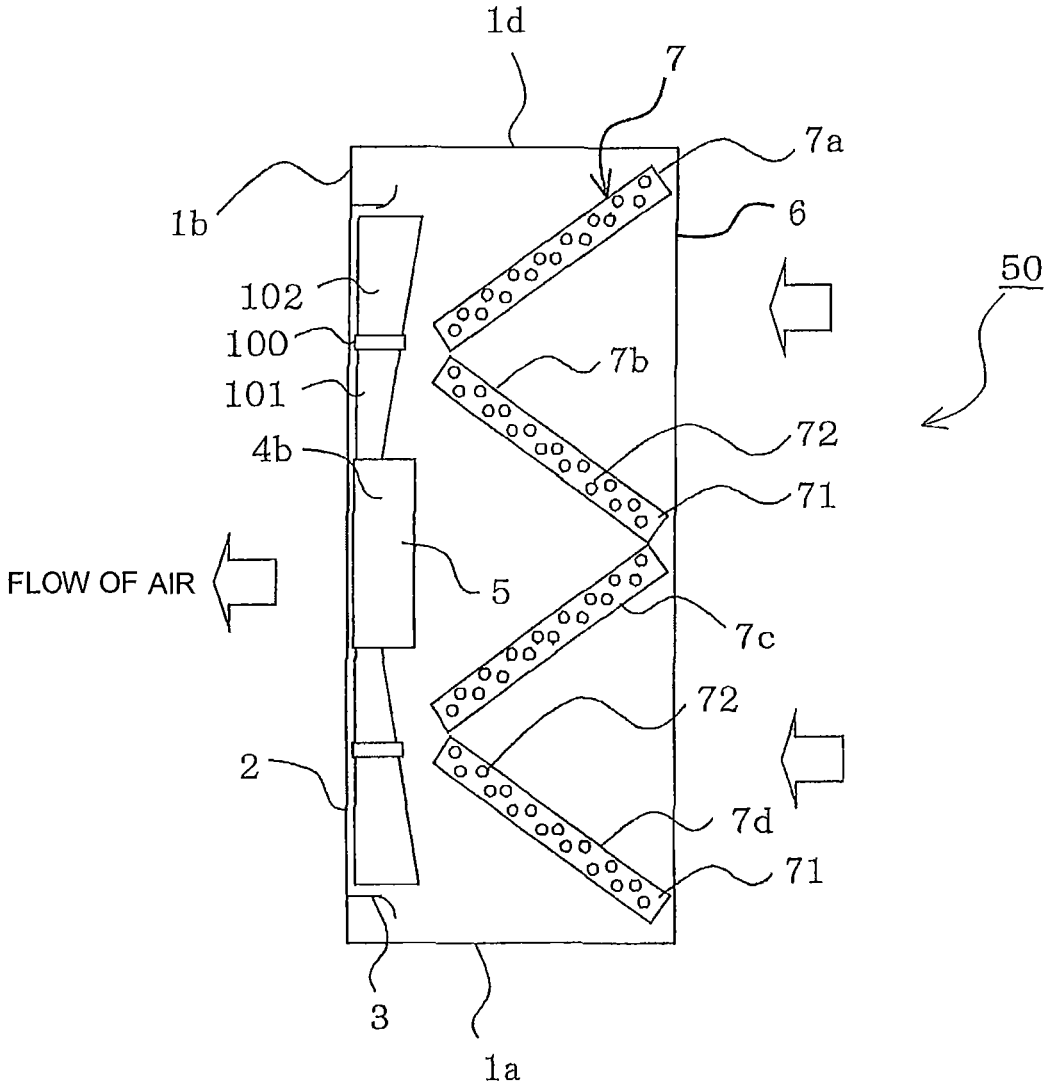
FIG. 8 is a schematic sectional view taken along line E-E illustrated in FIG. 7.

FIG. 7 is a perspective view of an outdoor unit for an air-conditioning apparatus according to Embodiment 3 of the present invention. FIG. 8 is a schematic sectional view taken along line E-E illustrated in FIG. 7. White arrows illustrated in FIG. 8 represent the flow of air passing through the outdoor unit.

As illustrated in FIGS. 7 and 8, the fan 4 according to Embodiment 3 includes an intermediate ring 100 provided between the boss 4*b* and outer peripheral portions of the blades 4*a* and connecting adjacent blades 4*a*. More specifically, the blades 4*a* include inner blades 101 provided between the boss 4*b* and the intermediate ring 100, and outer blades 102 provided on the outer side of the intermediate ring 100. In Embodiment 3, the number of outer blades 102 is larger than the number of inner blades 101, whereby the fan 4 provides a satisfactory level of aerodynamic performance. As illustrated in FIG. 8 (a virtual cross-section that contains the rotational axis of the fan 4 and is parallel to the direction in which the heat exchanger segments included in the heat exchanger 7 are arranged side by side), the position of the connection (folded portion) between the heat exchanger segment 7*a* and the heat exchanger segment 7*b* and the position of the connection (folded portion) between the heat exchanger segment 7*c* and the heat exchanger segment 7*d* substantially coincide with the position of the intermediate ring 100 in the direction in which the heat exchanger segments are arranged side by side.

The outdoor unit 50 according to Embodiment 3 produces the following advantageous effects, in addition to the effects described in Embodiment 1 and Embodiment 2.

In the fan 4 according to each of Embodiment 1 and Embodiment 2, the width of each of the blades 4*a* is reduced while the number of blades 4*a* is increased, whereby the thickness of the fan 4 in the axial direction is reduced. In the fan 4 according to Embodiment 3, the bases of the blades 4*a* have increased strength because of the presence of the intermediate ring 100 that connects adjacent blades 4*a*. Therefore, the width of each of the blades 4*a* can be further reduced, and the number of blades 4*a* can be further increased. Thus, the thickness of the fan 4 in the axial direction can be reduced more in Embodiment 3 than in each of Embodiment 1 and Embodiment 2.

As described above, since the thickness of each of the blades 4*a* of the fan 4 in the axial direction is further reduced, the space for installing the heat exchanger 7 in the outdoor unit 50 increases. Consequently, the volume of the heat exchanger 7 installable increases. Furthermore, air is relatively difficult to flow smoothly near the folded portions of the heat exchanger 7 (the connections between adjacent heat exchanger segments). However, since the positions of the folded portions substantially coincide with the position of the intermediate ring 100 where the blades 4*a* are absent, the reduction in the aerodynamic performance of the fan 4 caused by the presence of the intermediate ring 100 is prevented. Furthermore, since air does not flow toward the intermediate ring 100, there is no additional noise generated by the disturbance caused by the interference of the taken air with the intermediate ring 100. Thus, the thickness of the fan 4 can be reduced, that is, the volume of the heat exchanger 7 installed can be increased, without reducing the aerodynamic performance of the fan 4 and without increasing the noise.

In Embodiment 3, the ring that connects adjacent blades 4*a* extends over substantially middle portions of the blades 4*a*. Alternatively, the ring that connects adjacent blades 4*a* may extend over outer peripheral portions of the blades 4*a*, of course. In the latter case, the strength of the blades 4*a* is further increased.

In Embodiment 3, the positions of all of the folded portions of the heat exchanger 7 (connections between the heat exchanger segments) that are near the fan 4 substantially coincide with the position of the intermediate ring 100 in the direction in which the heat exchanger segments are arranged side by side. The above advantageous effects are produced if the position of at least one of the folded portions substantially coincides with the position of the intermediate ring 100.

Embodiment 4

Embodiments 1 to 3 each concern the outdoor unit 50 in which the air outlet 2 is provided in a lateral side portion of the casing 1. The present invention can also be embodied in an outdoor unit 50 in which the air outlet 2 is provided in the top portion of the casing 1, of course. Note that items that are not specifically described in Embodiment 4 are the same as those described in any of Embodiments 1 to 3, and like functions and like elements are denoted by like reference numerals.

Figure 9:
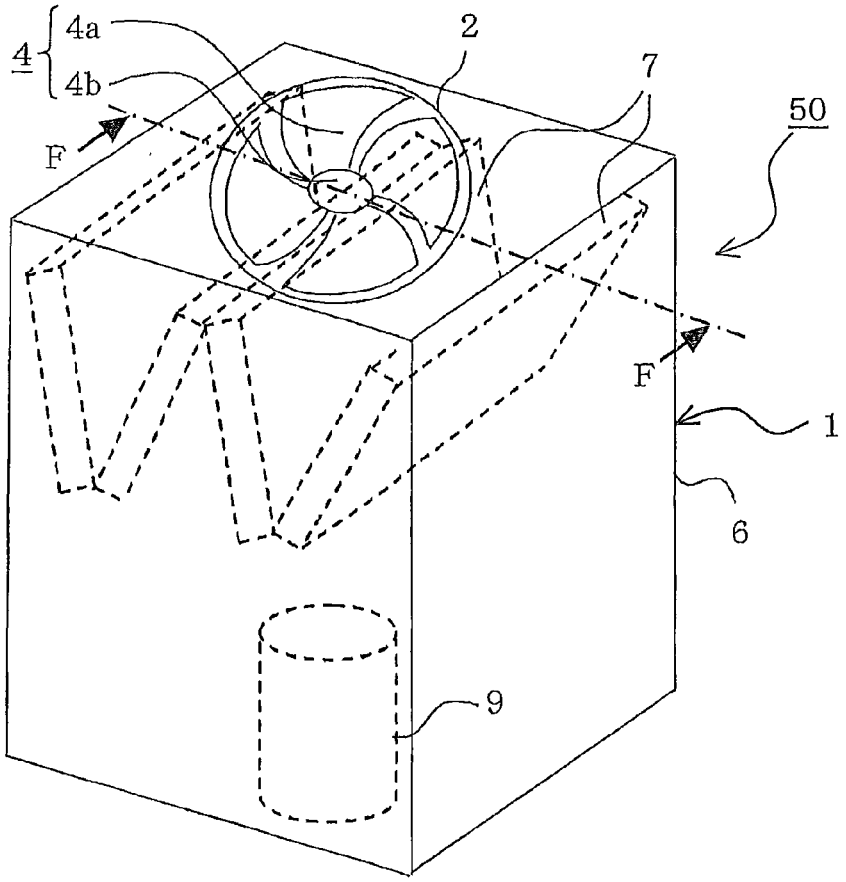
FIG. 9 is an external perspective view of an outdoor unit for an air-conditioning apparatus according to Embodiment 4 of the present invention.
Figure 10:
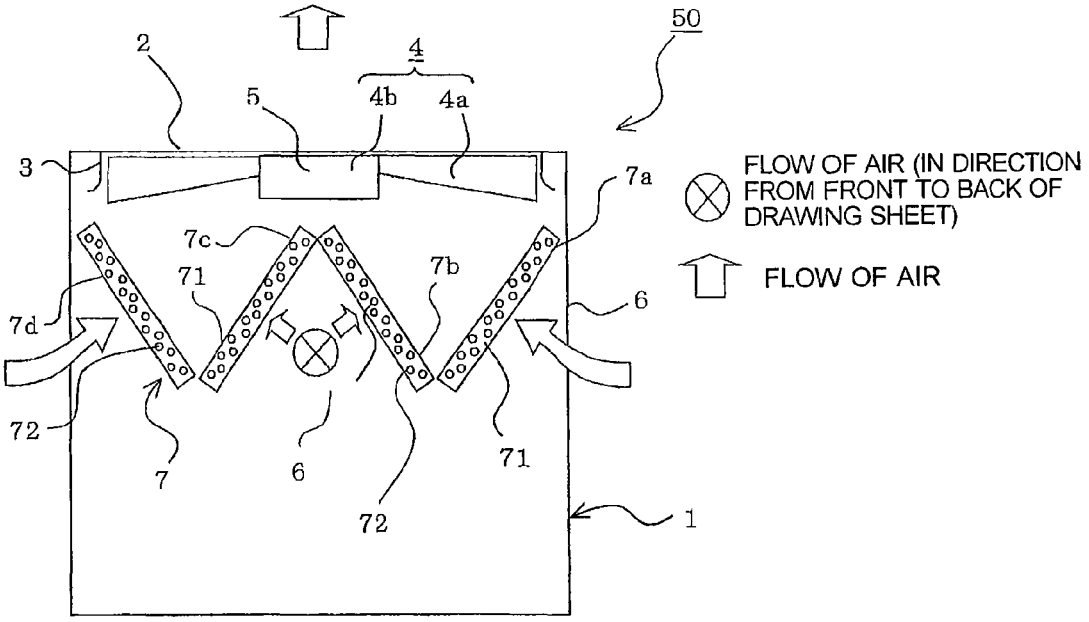
FIG. 10 is a schematic sectional view taken along line F-F illustrated in FIG. 9.

FIG. 9 is a perspective view of an outdoor unit for an air-conditioning apparatus according to Embodiment 4 of the present invention. FIG. 10 is a schematic sectional view taken along line F-F illustrated in FIG. 9. White arrows illustrated in FIG. 10 represent the flow of air passing through the outdoor unit. An encircled cross illustrated in FIG. 10 represents the flow of air oriented from the near side toward the far side of the surface of the drawing.

The outdoor unit 50 according to each of Embodiments 1 to 3 is a side-flow outdoor unit in which air flows through the fan 4 and the heat exchanger 7 that are provided side by side in the horizontal direction. The outdoor unit 50 according to Embodiment 4 is a top-flow outdoor unit in which air flows through the fan 4 and the heat exchanger 7 that are tilted by exactly 90 degrees in such a manner as to be provided side by side in the vertical direction. More specifically, as illustrated in FIGS. 9 and 10, the air outlet 2 is provided in the top plate 1*d* forming the top portion of the casing 1, and the fan 4 faces the air outlet 2. The heat exchanger 7 is provided below the fan 4. The air inlet 6 is provided in each of respective portions of the four side faces of the casing 1. That is, the casing 1 has an air passage in which air that is taken in from the air inlets 6 when the fan 4 is driven flows through the heat exchanger 7 and the fan 4 toward the air outlet. The compressor 9 is provided in an area at the bottom of the casing 1 that is outside the air passage. While Embodiment 4 employs the fan 4 according to Embodiment 1 or 2, the fan 4 according to Embodiment 3 may alternatively be employed, of course.

The heat exchanger 7 is divided into four heat exchanger segments (heat exchanger segments 7*a*, 7*b*, 7*c*, and 7*d*). The heat exchanger segments 7*a* to 7*d* are provided side by side in the horizontal direction and in a zigzag arrangement. That is, the heat exchanger 7 according to Embodiment 4 has three folded portions (positions where ends of adjacent heat exchanger segments are connected). An end of each of the heat exchanger segments 7*a*, 7*b*, 7*c*, and 7*d* that faces the fan 4 is positioned closely to the fan 4, whereby the heat exchanger 7 has a satisfactorily large draft area. The heat exchanger 7, that is, the heat exchanger segments 7*a* to 7*d*, includes fins 71 and heat transfer tubes 72. The fins 71 are stacked at specific intervals in the horizontal direction in such a manner as to provide gaps through which air flows.

An operation of the outdoor unit 50 according to Embodiment 4 will now be described.

As illustrated in FIG. 10, air on the outside of the outdoor unit 50 flows into the outdoor unit 50 from the air inlets 6 provided in the four respective side faces. Then, the flow of the air is redirected upward, passes through the heat exchanger 7 and the fan 4, and is exhausted from the air outlet 2. While the air flows through the gaps between the fins 71 of the heat exchanger 7, the air exchanges heat with the heat exchanger 7.

In addition to the advantageous effects described in Embodiment 1, the outdoor unit 50 according to Embodiment 2 exerts a greater effect of reducing the draft resistance of the heat exchanger 7 because the gaps between the fins 71 spread in the vertical direction, allowing air to easily flow in the vertical direction when passing through the heat exchanger 7. Thus, the fan input is reduced. Furthermore, even if the volume of airflow is increased with the increase in the volume of the heat exchanger 7 installed, the increase in the draft speed in the heat exchanger 7 is suppressed because the draft area is also increased. Therefore, the heat exchanging performance of the heat exchanger 7 can be efficiently improved without increasing the draft resistance.

In Embodiment 4, one fan 4 is provided. To increase the volume of airflow in correspondence with the volume of the heat exchanger 7 installed, a plurality of fans 4 may be provided. For example, two fans 4 may be provided such that the centers thereof in the horizontal direction are positioned closely to the connection (folded portion) between the heat exchanger segment 7*a* and the heat exchanger segment 7*b* and near the connection (folded portion) between the heat exchanger segment 7*c* and near the heat exchanger segment 7*d*, respectively. However, in Embodiment 4, one fan 4 having a large blade diameter is provided for producing a predetermined volume of airflow. This is because of the following reason. Since a predetermined volume of airflow is produced with one fan 4 having a large blade diameter, the fan 4 is efficiently operable at a relatively low rotation speed while suppressing the generation of noise. By providing several heat exchanger segments in a zigzag arrangement within an area that faces one fan 4 as described above, that is, by providing several folded portions within an area that faces one fan 4, the volume of the heat exchanger per fan 4 is increased. Therefore, the heat exchanging performance is improved without increasing the draft resistance, that is, the fan input. Moreover, the efficiency of the fan 4 is improved, and the noise generation is reduced.

In Embodiment 4, the number of folds in the heat exchanger 7 (i.e., the number of connections between heat exchanger segments included in the heat exchanger 7) is three. However, the number of folds is not limited to three. For example, the number of folds in the heat exchanger 7 may be four or more. In that case, the draft resistance also increases. Therefore, it is preferable that the specifications of the heat exchanger 7 be selected according to need. For example, the thickness of the heat exchanger 7 may be reduced.

In Embodiment 4, the four heat exchanger segments (the heat exchanger segments 7*a*, 7*b*, 7*c*, and 7*d*) included in the heat exchanger 7 are provided separately from one another. Alternatively, the heat exchanger segments may be manufactured as an integral body while, for example, slits are made in some of the fins 71 that are provided in portions to be folded, and the integral body may be then folded at those portions. If the heat exchanger segments are manufactured as an integral body, no fins 71 may be provided at the folded portions, originally. If no fins 71 are provided at the folded portions, the ease of folding of the heat exchanger 7 increases. Moreover, it is originally difficult at the folded portions for air to flow smoothly, and such air makes less contribution to heat exchange. Therefore, the amount of fin material to be used can be reduced without reducing the heat exchanging performance of the heat exchanger 7.

In Embodiment 4, the heat exchanger segments are arranged zigzag such that the connection (folded portion) between the heat exchanger segment 7*b* and the heat exchanger segment 7*c* is positioned closely to the boss 4*b* of the fan 4 while the connection (folded portion) between the heat exchanger segment 7*a* and the heat exchanger segment 7*b* and the connection (folded portion) between the heat exchanger segment 7*c* and the heat exchanger segment 7*d* are positioned closely to the air inlets 6. However, the arrangement of the heat exchanger segments is not limited to such a pattern. For example, the heat exchanger 7 may be inverted in the direction of airflow. That is, the heat exchanger segments may be arranged zigzag such that the connection (folded portion) between the heat exchanger segment 7*b* and the heat exchanger segment 7*c* is positioned closely to the air inlets 6 while the connection (folded portion) between the heat exchanger segment 7*a* and the heat exchanger segment 7*b* and the connection (folded portion) between the heat exchanger segment 7*c* and the heat exchanger segment 7*d* are positioned closely to the fan 4.

In summary, while Embodiments 1 to 4 each concern a case where the heat exchanger 7 is provided on the windward side of the fan 4, the heat exchanger 7 may alternatively be provided on the leeward side of the fan 4. For example, in the case of the outdoor unit 50 according to Embodiment 1, air may be taken in from the front panel 1*b*, and the taken air may be supplied to the heat exchanger 7 provided on the leeward side. Such a case also produces an advantageous effect of promoting heat transfer by the collision of the air, which is blown from the fan 4 at a high speed, with the heat exchanger 7. Therefore, the heat exchanging performance of the heat exchanger 7 is further improved.

The present invention has been described in Embodiments 1 to 4 each concerning an exemplary case where the fan 4 includes the fan motor 5 housed in the boss 4*b*. The present invention is not limited to such a case. The fan motor may be an external motor that is provided in such a manner as to project from the boss 4*b* in the axial direction.

REFERENCE SIGNS LIST

1 casing 1*a* base plate 1*b* front panel 1*c* side panel 1*d* top plate 2 air outlet 3 bell mouth 4 fan 4*a* blade 4*b* boss 5 fan motor 6 air inlet 7 heat exchanger 7*a* to 7*e* heat exchanger segment 8 partition 9 compressor 10 machine chamber 50 outdoor unit 71 fin 72 heat transfer tube 100 intermediate ring 101 inner blade 102 outer blade

The invention claimed is:

1. An outdoor unit for an air-conditioning apparatus comprising a heat exchanger, at least one fan, a compressor, and a box-shaped casing, the casing housing the heat exchanger, the at least one fan, and the compressor and having an air inlet and an air outlet, wherein the heat exchanger includes a plurality of heat exchanger segments, wherein the heat exchanger segments are arranged zigzag, wherein the at least one fan and the heat exchanger face each other in a horizontal direction, wherein the plurality of heat exchanger segments are provided side by side in a vertical direction and in a zigzag arrangement, wherein the heat exchanger segments each include a plurality of fins that are stacked at predetermined intervals and a pipe that extends through the fins, and wherein a direction in which the fins are stacked is a horizontal direction.

2. The outdoor unit for an air-conditioning apparatus of claim 1, wherein the compressor is provided at a position outside an air passage in which air taken in from the air inlet flows through the heat exchanger and the at least one fan toward the air outlet.

3. The outdoor unit for an air-conditioning apparatus of claim 1, wherein, in an area of the heat exchanger, the area facing one fan of the at least one fan, the plurality of heat exchanger segments are arranged zigzag such that three or more folded portions where ends of adjacent ones of the heat exchanger segments are connected are formed, or, in a virtual cross-section taken in a direction in which the plurality of heat exchanger segments are provided side by side, the plurality of heat exchanger segments are arranged zigzag such that ends of the plurality of heat exchanger segments, the ends facing the one fan, are positioned closely to the one fan.

4. The outdoor unit for an air-conditioning apparatus of claim 1, wherein the at least one fan includes a blade, a boss and a motor, and wherein the motor is provided in the boss.

5. The outdoor unit for an air-conditioning apparatus of claim 1, wherein the at least one fan includes a plurality of blades, a boss, and a motor, and wherein an outer peripheral ring that connects adjacent ones of the blades extends over outer peripheral portions of the blades.

6. The outdoor unit for an air-conditioning apparatus of claim 1, wherein the at least one fan includes a plurality of blades, a boss, and a motor, and wherein an intermediate ring that connects adjacent ones of the blades is provided between the boss and outer peripheral portions of the blades.

7. The outdoor unit for an air-conditioning apparatus of claim 6, wherein, when observed in a virtual cross-section that contains a rotational axis of the at least one fan and that is taken in a direction in which the plurality of heat exchanger segments included in the heat exchanger are provided side by side, a position of at least one of connections between ends of adjacent ones of the heat exchanger segments substantially coincide with a position of the intermediate ring in the direction in which the heat exchanger segments are provided side by side.

8. The outdoor unit for an air-conditioning apparatus of claim 1, wherein the compressor is separated from an air passage in which air taken in from the air inlet flows to the air outlet via the heat exchanger and the at least one fan, by a partition provided in the casing, and the heat exchanger includes a plurality of fins stacked at predetermined intervals, and a pipe extending through the fins, and wherein a side plate of the heat exchanger is designed to be integrated with the partition and to serve also as the partition.

9. The indoor unit for an air-conditioning apparatus of claim 1, wherein the heat exchanger includes a plurality of fins stacked at predetermined intervals, a pipe extending through the fins, and wherein the plurality of heat exchanger segments are formed of an integral fin in which a slit is formed, and are arranged zigzag by being folded at the slit.

10. An outdoor unit for an air-conditioning apparatus comprising a heat exchanger, at least one fan, a compressor, and a box-shaped casing, the casing housing the heat exchanger, the at least one fan, and the compressor and having an air inlet and an air outlet, wherein the heat exchanger includes a plurality of heat exchanger segments, wherein the heat exchanger segments are arranged zigzag, wherein the at least one fan includes a plurality of blades, a boss, and a motor, and wherein an intermediate ring that connects adjacent ones of the blades is provided between the boss and outer peripheral portions of the blades, and wherein when observed in a virtual cross-section that contains a rotational axis of the at least one fan and that is taken in a direction in which the plurality of heat exchanger segments included in the heat exchanger are provided side by side, a position of at least one of connections between ends of adjacent ones of the heat exchanger segments substantially coincide with a position of the intermediate ring in the direction in which the heat exchanger segments are provided side by side.

11. The air-conditioning apparatus of claim 10, wherein the compressor is provided at a position outside an air passage in which air taken in from the air inlet flows through the heat exchanger and the at least one fan toward the air outlet.

12. The outdoor unit for an air-conditioning apparatus of claim 10, wherein, in an area of the heat exchanger, the area facing one fan of the at least one fan, the plurality of heat exchanger segments are arranged zigzag such that three or more folded portions where ends of adjacent ones of the heat exchanger segments are connected are formed, or, in a virtual cross-section taken in a direction in which the plurality of heat exchanger segments are provided side by side, the plurality of heat exchanger segments are arranged zigzag such that ends of the plurality of heat exchanger segments, the ends facing the one fan, are positioned closely to the one fan.

13. The outdoor unit for an air-conditioning apparatus of claim 10, wherein the at least one fan and the heat exchanger face each other in a horizontal direction, and wherein the plurality of heat exchanger segments are provided side by side in a horizontal direction and in a zigzag arrangement.

14. The outdoor unit for an air-conditioning apparatus of claim 13, wherein the heat exchanger segments each include a plurality of fins that are stacked at predetermined intervals and a pipe that extends through the fins, and wherein a direction in which the fins are stacked is a horizontal direction.

15. The outdoor unit for an air-conditioning apparatus of claim 10, wherein the at least one fan and the heat exchanger face each other in a vertical direction, and wherein the plurality of heat exchanger segments are provided side by side in a horizontal direction and in a zigzag arrangement.

16. The outdoor unit for an air-conditioning apparatus of claim 15, wherein the heat exchanger segments each include a plurality of fins that are stacked at predetermined intervals and a pipe that extends through the fins, and wherein a direction in which the fins are stacked is a horizontal direction.

* * * * *